United States Patent [19]

Lindahl et al.

[11] 4,244,778

[45] Jan. 13, 1981

[54] PROCESS FOR THE CHEMICAL REFINING OF CELLULOSE PULP

[75] Inventors: Jonas A. I. Lindahl, Domsjo; Claes G. S. Svensson, Kode, both of Sweden

[73] Assignee: MoDo-Chemetics AB, Ornskoldsvik, Sweden

[21] Appl. No.: 26,470

[22] Filed: Apr. 2, 1979

[30] Foreign Application Priority Data

Mar. 31, 1978 [SE] Sweden ..... 7803674

[51] Int. Cl.[3] ..... D21C 3/26

[52] U.S. Cl. ..... 162/17; 162/19; 162/46; 162/57; 162/60; 162/63; 162/68; 162/72; 162/76; 162/78; 162/80; 162/83; 162/90

[58] Field of Search ..... 162/17, 24, 25, 26, 162/57, 68, 71, 78, 83, 70, 90, 28, 84, 63, 100, 60, 76, 72, 46, 80, 82, 19; 8/156

[56] References Cited

U.S. PATENT DOCUMENTS

| | | | |
|---|---|---|---|
| 2,513,344 | 7/1950 | McEwen | 162/25 |
| 2,707,146 | 4/1955 | Burton | 162/83 |
| 2,920,011 | 1/1960 | Eilers | 162/78 |
| 2,963,395 | 12/1960 | Back et al. | 162/83 |
| 3,255,071 | 6/1966 | Kleinert | 162/90 |
| 3,256,614 | 6/1966 | Dunbar | 162/100 |
| 3,668,063 | 6/1972 | Engstrom | 162/68 |
| 4,030,969 | 6/1977 | Asplund et al. | 162/24 |
| 4,160,693 | 7/1979 | Lindahl et al. | 162/24 |

FOREIGN PATENT DOCUMENTS

| | | | |
|---|---|---|---|
| 799172 | 11/1968 | Canada | 162/57 |

*Primary Examiner*—Peter Chin

[57] ABSTRACT

A process is provided for the chemical refining of cellulose pulp which comprises, in sequence, the steps of:

(1) impregnating the cellulose pulp with refining chemicals in an amount selected to effect chemical modification of the pulp;

(2) adjusting the pulp consistency to within the range from about 30 to about 70%; and (3) passing the pulp in turbulent flow through an elongated reaction zone from one end to another end thereof in a gaseous atmosphere consisting essentially of steam and preferably containing less than 1% by volume of oxygen at a superatmospheric pressure within the range from about 5 to about 400 kPa and a temperature within the range from about 100 to about 150° C. at which the chemical modification proceeds without a mechanical working sufficient to change the degree of beating of the pulp by more than about 2° (Schopper-Riegler) and the freeness of the pulp by more than about 10 ml, and with less than an 8% change in the pulp dry solids content, at a flow rate such that the impregnated chemicals are substantially completely consumed by the time the pulp reaches the end of the zone.

20 Claims, 1 Drawing Figure

PROCESS FOR THE CHEMICAL REFINING OF CELLULOSE PULP

Figure 1:
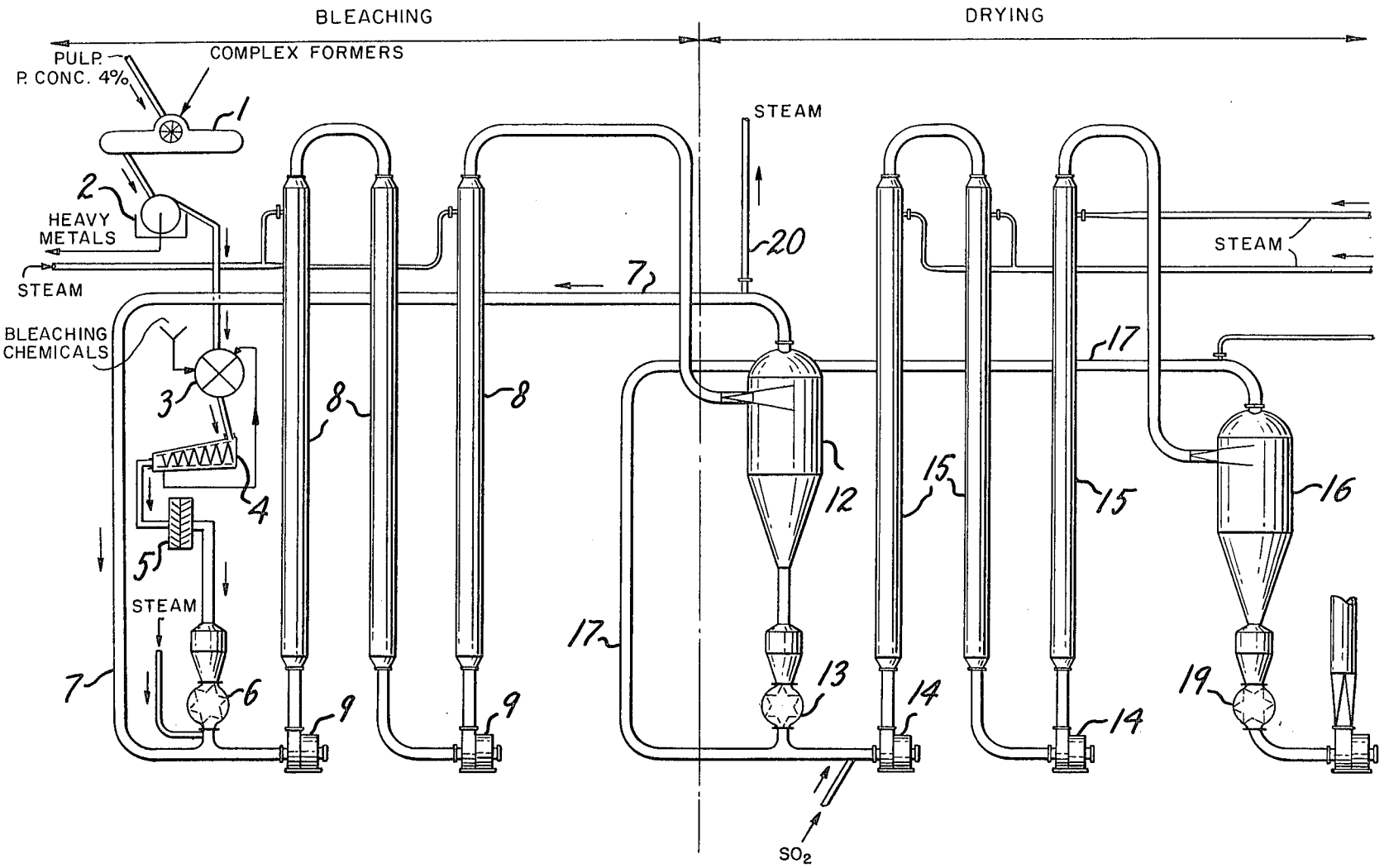

The bleaching of chemical, semichemical and mechanical pulps with bleaching agents such as chlorine, chlorine dioxide, hypochlorite, and lignin-preserving bleaching agents such as peroxides and dithionite is usually carried out by impregnating the pulp with the bleaching chemicals and then effecting the bleaching reaction at a pulp consistency below about 20% for several hours at temperatures seldom exceeding 85° C. The extraction of cellulose pulps with aqueous alkaline solutions in order to remove hemicellulose and other alkali-soluble materials such as resins, fatty acids and unsaponifiable substances is normally effected by impregnating the pulp with aqueous alkali, such as sodium hydroxide, and then allowing the alkali to react with the pulp for several hours at temperatures generally below 85° C. However, hot alkali-refining can also be used at temperatures above 85° C., when producing dissolving cellulose pulp.

Svensk Papperstidning No. 15 pp 480–482 (1977) shows that in experiments with peroxide bleaching of unbleached sulfate pulp at 110° C. in a digester, a very rapid and complete reaction between the peroxide and the pulp is established. The experiments indicate that the reaction mechanism depends upon temperature, and that there are different reaction mechanisms at high temperatures and at low temperatures. In spite of this, for reasons of economy, a two-stage bleaching sequence was proposed utilizing oxygen, followed by peroxide, at 70° C., instead of a single stage peroxide bleaching at above 100° C., in order to obtain a sufficient increase in brightness in the bleaching of sulfate pulp, even though the selectivity may be lower than in a single stage high temperature peroxide bleaching. The experiments were carried out with the pulp in a stationary bed at a pulp consistency of 30% for bleaching times as short as 5 minutes.

U.S. Pat. No. 3,492,199, patented Jan. 27, 1970, discloses a process for simultaneously bleaching and drying mechanical pulp in order to obtain rapid drying of the pulp while obtaining a high brightness. The finely-divided pulp is impregnated with hydrogen peroxide at a pulp consistency of from 20 to 50%, and is then dried in an air stream at a temperature of from 260° to 538° C. at atmospheric pressure in a transit time of from 2 seconds to 10 minutes to a solids content of from 65 to 95%. However, in this process the consumption of bleaching chemicals is high, and energy consumption is excessive, while the content of fiber notes is unacceptable. Moreover, the pulp cannot be treated with reducing sulfur compounds added in the drying gas, and bleaching with reducing bleaching agents such as dithionite is impossible, since these decompose in the presence of oxygen at the high drying temperatures.

In accordance with the invention, a process is provided for chemically refining cellulose pulps using, for example, bleaching agents and/or alkaline extracting agents, which gives a cellulose pulp having good pulp characteristics in a short processing time with a low consumption of chemicals and a low energy consumption. The process in accordance with the invention comprises, in sequence, the steps of:

(1) impregnating the cellulose pulp with refining chemicals in an amount selected to effect chemical modification of the pulp;

(2) adjusting the pulp consistency to within the range from about 30 to about 70%; and (3) passing the pulp in turbulent flow through an elongated reaction zone from one end to another end thereof in a gaseous atmosphere consisting essentially of steam and preferably containing less than 1% by volume of oxygen at a superatmospheric pressure within the range from about 5 to about 400 kPa and at a temperature within the range from about 100° to about 150° C. at which the chemical modification proceeds without a mechanical working sufficient to change the degree of beating of the pulp by more than about 2° (Schopper-Riegler) and the freeness of the pulp by more than about 10 ml, and with less than an 8% change in the pulp dry solids content, at a flow rate such that the impregnated chemicals are substantially completely consumed by the time the pulp reaches the end of the zone.

In the course of step (3), the fibers should not be either shortened or fibrillated by mechanical working. The shortness is defined by the degree of beating of the pulp, and the fibrillation by the freeness of the pulp. Consequently, a change of ± about 2° (Schopper-Riegler) in the degree of beating and of ± about 10 ml in the freeness is undesirable, and is to be avoided.

The process of the invention is applicable to cellulose pulps of all kinds, prepared by any chemical or mechanical pulping process or mixture of chemical and mechanical pulping processes from any kind of lignocellulosic material such as straw, bagasse, or wood. Thus, the invention is applicable to chemical pulps, such as sulfate pulps, soda pulps, and sulfite pulps, semichemical pulps, chemimechanical pulps, and to mechanical pulps, such as groundwood pulps produced at normal pressure or superatmospheric pressure, refiner mechanical pulps, and thermomechanical pulps.

The invention is especially applicable to cellulose pulps derived from wood, such as spruce pulp, pine pulp, hemlock pulp, birch pulp, fir pulp, cherry pulp, sycamore pulp, hickory pulp, ash pulp, beech pulp, poplar pulp, oak pulp, and chestnut pulp. The invention is particularly advantageous in the preparation of any pulp in which it is especially desired to avoid degradation of the cellulose during processing, such as most grades of paper pulp, and when it is desired to obtain a uniform controlled degradation, such as in the manufacture of viscose pulp of a desired viscosity.

In most cases where the starting cellulose pulp is free of lignin, or where the lignin content is low, either naturally so, or because it has been delignified, the process of the invention can be applied to remove hemicellulose, and/or cause oxidation of the cellulose, with a regulated diminution of the pulp viscosity.

The method has shown particularly favorable results with hardwood pulps, such as pulp from birch and/or aspen, but good results have also been obtained with pulps from softwood, e.g., spruce and/or pine.

The term "chemical refining" is used herein to refer to a modification of the cellulose pulp by chemical treatment, of which bleaching and alkali extraction are preferred embodiments, and are illustrative.

In bleaching, any chemical bleaching agents can be used, such as, for example, chlorine, chlorine dioxide, hypochlorous acid, sodium hypochlorite, calcium hypochlorite, peroxide compounds such as hydrogen peroxide, sodium peroxide, sodium perborate, barium peroxide, peracetic acid, performic acid, perpropionic acid, and sodium dithionite. Additional peroxide bleaching chemicals can be added, such as stabilizers and pH modifiers, for example, sulfuric acid, sodium hydroxide, sodium silicate, sodium phosphate, and magnesium sulfate. Preferred bleaching agents are hypochlorite and lignin-preserving bleaching agents such as peroxides and sodium dithionite.

Alkali extraction can be carried out with any aqueous alkali solution. Sodium hydroxide and magnesium hydroxide are preferred, but potassium hydroxide, calcium hydroxide, sodium carbonate, sodium bicarbonate, potassium carbonate and potassium bicarbonate can also be used.

Bleaching in the process of the invention is enhanced if the pulp prior to the treatment is impregnated with a complexing agent. The pulp should have a low consistency within the range of 1 to 10%, for uniform distribution of the agent throughout the pulp. The complexing agent is capable of chelating with or sequestering heavy metal or polyvalent metal cations. The complexing agent is effective however in inhibiting degradation of the cellulose even if no polyvalent metal cations are present. Preferred complexing agents are hydroxy carboxylic acids, amino carboxylic acids, and polyphosphates, for example, nitrilotriamino acetic acid, diethylene triamine pentaacetic acid, ethylene diamine tetraacetic acid, citric acid, tartaric acid, pentasodium tripolyphosphate, and tetrasodium pyrophosphate.

The complexing amino polycarboxylic acids have the formula:

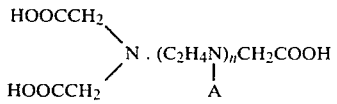

and the alkali metal salts thereof, in which A is the group $—CH_2COOH$ or $—CH_2CH_2OH$, where n is an integer from zero to five. The mono, di, tri, tetra, penta and higher alkali metal salts are useful, according to the number of acid groups available and converted to alkali metal salt form.

Examples of such aminopolycarboxylic acids are ethylene diamine tetraacetic acid, nitrilotriacetic acid, diethylene triaminopentaacetic acid, ethylene diamine triacetic acid, tetraethylene pentaamine heptaacetic acid, and hydroxy ethyl ethylene diamine triacetic acid, and their alkali metal salts, including the mono, di, tri, tetra and penta sodium, potassium and lithium salts thereof. Other types of amino carboxylic acids which can be used to advantage are imino diacetic acid, 2-hydroxy ethyl imino diacetic acid, cyclohexane diamine tetraacetic acid, anthranil-N,N-diacetic acid, and 2-picolylamine-N,N-diacetic acid.

Also effective complexing agents are the aliphatic alpha-hydroxy carboxylic acids of the type RCHOH-COOH and the corresponding beta-hydroxy carboxylic acids $RCHOHCH_2COOH$; having the formula:

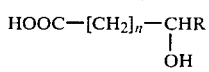

In the above formula, n is zero or one. When n is zero, the acid is an alpha-hydroxy acid, and when n is one, the acid is a beta-hydroxy acid.

R in the above formula is hydrogen or an aliphatic radical, which may be a hydrocarbon radical having from one to about ten carbon atoms, or a hydroxy-substituted hydrocarbon radical having from one to nine hydroxyl groups, and from one to about ten carbon atoms.

Exemplary alpha- and beta-hydroxy carboxylic acids are glycolic acid, lactic acid, glyceric acid, α,β-dihydroxy butyric acid, α-hydroxy-butyric acid, α-hydroxy-isobutyric acid, α-hydroxy-n-valeric acid, α-hydroxy-isovaleric acid, β-hydroxy-butyric acid, β-hydroxy-isobutyric acid, β-hydroxy-n-valeric acid, β-hydroxy-isovaleric acid, erythronic acid, threonic acid, trihydroxy-isobutyric acid, and sugar acids and aldonic acids, such as gluconic acid, galactonic acid, talonic acid, mannonic acid, arabonic acid, ribonic acid, xylonic acid, lyxonic acid, gulonic acid, idonic acid, altronic acid, allonic acid, ethenyl glycolic acid, and β-hydroxy-isocrotonic acid.

Also useful are organic acids having two or more carboxylic groups, and no or from one to ten hydroxyl groups, such as oxalic acid, malonic acid, tartaric acid, malic acid, and citric acid, ethyl malonic acid, succinic acid, isosuccinic acid, glutaric acid, adipic acid, suberic acid, azelaic acid, maleic acid, fumaric acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

The polyphosphoric acids are also good complexing agents, and the alkali metal salts of these acids are useful, alone or in combinations with the complexing amino polycarboxylic acid salts. Exemplary are tetrasodium pyrophosphate, pentasodium tripolyphosphate and sodium polymetaphosphate.

Especially advantageous complexing agents from the standpoint of cost are the acids naturally present in waste liquors obtained from the alkaline treatment of cellulosic materials. These acids represent the alkali- or water-soluble degradation products of polysaccharides which are dissolved in such liquors, as well as alkali- or water-soluble degradation products of cellulose and hemicellulose. The chemical nature of these degradation products are complex, and they have not been fully identified. However, it is known that saccharinic and lactic acids are present in such liquors, and that other hydroxy acids are also present. The presence of $C_6$-isosaccharinic and $C_6$-metasaccharinic acids has been demonstrated, as well as $C_4$- and $C_5$-metasaccharinic acids. Glycolic acid and lactic acid are also probable degradation products derived from the hemicelluloses, together with beta-gammadihydroxy butyric acid.

Carbohydrate acid-containing cellulose waste liquors which can be used include the liquors obtained from the hot alkali treatment of cellulose, liquors from sulfite digestion processes, and liquors from sulfate digestion processes, i.e., kraft waste liquor. The waste liquors obtained in alkaline oxygen gas bleaching or digestion processes and alkaline peroxide bleaching processes can also be used. In this instance, the alkaline liquor can be taken out from the process subsequent to completing the oxygen gas treatment stage, or during the actual treatment process. The impregnation with bleaching agent is then carried out, usually simply by mixing an aqueous solution of the bleaching chemicals with the pulp suspension.

The aqueous bleaching solution is then uniformly distributed in the pulp suspension using, for example, agitation, such as in a blade or propeller mixer of conventional type.

The amount of bleaching agent can be within the range from about 0.2% to about 6% by weight of the dry weight of the pulp, and is preferably within the range from about 0.5 to about 5%.

The consistency of the pulp during the bleaching should be within the range from about 30 to about 70%, although consistencies within the range from about 45 to about 65% are preferred. The pulp can be dewatered or diluted, according to the consistency of the starting pulp, so that a consistency within the stated range is obtained. A press is preferably used for dewatering. The excess of the impregnating chemical solution is recovered.

In alkali extraction, the alkali-soluble materials, such as hemicellulose and resins as well as alkali-hydrolyzable substances such as carbohydrates, are removed and dissolved in the alkali extraction solution. Alkali extraction is very suitable, for example, in producing dissolving pulp, i.e., alkali-soluble pulp.

Any alkali can be used, such as, for example, sodium hydroxide, potassium hydroxide, magnesium hydroxide, calcium hydroxide and cuprammonium solutions. The alkali concentration is not critical, and can be within the range from about 1 to about 50% in the extracting solution. The amount of alkali is adjusted according to the materials to be removed, and is within the range from about 0.5 to about 10% by weight based on the solids content of the pulp, preferably within the range from about 1 to about 6% based on the solids content of the pulp.

For optimum chemical modification in the refining treatment of the invention, the pulp fibers should be in finely divided form. If the pulp is then not sufficiently finely divided, it can be further defibrated in a disc refiner.

The pulp suspension is then ready to be passed through the elongated reaction zone, from one end to the other end thereof, during which the reaction between the impregnated chemicals and the pulp is carried out.

In its passage through the zone, the pulp suspension is bathed in a steam atmosphere and also is heated by the steam which is at superatmospheric pressure. The temperature is within the range from about 100° to about 150° C., and the steam superatmospheric pressure is within the range from about 5 to about 400 kPa, preferably from about 50 to about 300 kPa, and still more preferably at from about 100 to about 200 kPa. The atmosphere contains less than 1% oxygen and other gases, if the chemical refining agent is reactive with oxygen or other gases, at the refining process temperature.

The steam and pulp are thoroughly blended in turbulent flow, to ensure adequate mixing in transit through the zone. This can be done mechanically using, for example, fans or agitators, or a pump, or a helical screw conveyor. Pneumatic turbulence can be achieved by fans, or by bubbling the steam into the pulp using sparging apparatus or similar conventional equipment.

The rate of transit through the reaction zone is dependent upon the temperature and the type of chemical refining being carried out, and is normally at least 10 meters per second, so as to ensure a traverse time within which the impregnating chemicals are substantially completely consumed and the chemical modification completed to the required extent. The reaction is surprisingly fast under the proper turbulent flow conditions, and can be completed within as little as 5 seconds, and at most in a matter of minutes, but usually not in excess of about 10 minutes. A preferred transit time is within the range from about 5 seconds to about 60 seconds.

During transit through the reaction zone, the dry solids content of the pulp should not change appreciably. A maximum change increment of 8% is acceptable, but preferably the change is less than 6%, and still more preferably, there is no substantial change at all.

If the treated pulp has been bleached, the dry solids content of the pulp at the delivery end of the reaction zone should be at least 40%, and if the pulp has been alkali-refined or extracted, the pulp dry solids content should be at least 30%.

After transit through the reaction zone, the steam is separated from the pulp. If the chemical refining is an alkaline extraction, the pulp is washed after steam separation. If the chemical refining is a bleaching, washing is optional, and not essential. The materials dissolved out in the alkali extraction liquor or bleaching liquor are of course separated with the liquor.

Steam separation can be carried out in any conventional steam-separating equipment, such as, for example, a cyclone or hydrocyclone, or a centrifuge.

Thereafter, the pulp can be dried, or further treated as required. A pulp which has been extracted with alkali can be bleached, and likewise a pulp that has been bleached can be bleached in another stage, using the same or another bleaching agent, if desired in a repetition of the process of the invention, by recycling the pulp to the apparatus, or passing it on to a second apparatus in series with the first.

After drying, and with or without further treatment, the pulp can be used in the production of paper, and in other ways.

The drying of the pulp following the separation of steam and washing, if applied, can be carried out using the usual drying apparatus. A flash drying is particularly suitable, the pulp being suspended in a turbulent gas stream such as steam or air, at a temperature within the range from about 110° to about 500° C. The transfer of heat from the carrier gas to the pulp is thereby facilitated.

A preferred drying carrier gas is superheated steam at a superatmospheric pressure within the range from about 20 to about 400 kPa. Very good economy can be achieved by using the excess steam after the drying for heating and other purposes, such as a source of heat in the refining of the invention. The excess steam can also be recycled to the drying, after reheating.

A preferred drying apparatus is the so-called "counter pressure" dryer described in U.S. Pat. No. 4,043,049, patented Aug. 23, 1977, the disclosure of which is hereby incorporated by reference. In this drying apparatus, the pulp is dried in the form of particles or flakes which flow through vertical towers under a superatmospheric pressure of steam at a high rate, for example, 21 meters per second. The pulp particles or flakes and steam are driven at high speed by means of fans. The carrier steam is heated indirectly by pressurized steam pipes, the temperature of which can be considerably higher than that of the carrier steam. The carrier steam heats the moist pulp instantaneously, which leads to a rapid evaporation of the moisture in the pulp. In this flash drying process, a dried pulp is obtained in from 10 to 20 seconds.

During drying, the pump can be treated with pH adjusting substances, such as sulfur dioxide gas, which can be supplied to the pulp with the carrier steam, or calcium oxide in finely divided powder form.

The excess steam is recovered from the dried pulp in a steam separator, such as a cyclone.

The following Examples in the opinion of the inventors represent preferred embodiments of the invention:

EXAMPLE 1

Chemimechanical washed birch cellulose pulp, obtained by partial delignification with sodium bisulfite followed by defibration in a disc refiner, and having a brightness of 66% SCAN, was processed in the apparatus shown in FIG. 1. First, the pulp was mixed in mixer 1 with hot water and 0.2% diethylenetriamine pentaacetic acid based on the dry weight of the pulp to a pulp consistency of 4% at a temperature of 62° C. The pulp was allowed to stand for thirty minutes, and then dewatered in the press 2 to a 35% solids content. The dewatered pulp was then shredded to pieces approximately 1 $cm^2$, and mixed in mixer 3 with an aqueous bleaching solution of 28 g/l hydrogen peroxide, 50 g/l sodium silicate, 18 g/l sodium hydroxide and 0.2 g/l magnesium sulfate. After mixing in the bleaching solution, the pulp was dewatered in a screw press 4 to a 50% solids content, in order to remove excess bleaching chemicals. The dewatered pulp was found by analysis to contain 3% hydrogen peroxide, 5% sodium silicate, 1.5% sodium hydroxide and 0.02% magnesium sulfate, based on the dry weight of the pulp.

The pulp was then ground in disc refiner 5 to individual fibers and fiber bundles, and then continuously fed by way of a sluice or rotary vane feeder 6 into a stream of recycled steam as a carrier gas from line 7 and then in the first stage 8, a flash dryer of U.S. Pat. No. 4,043,049, modified as shown in FIG. 1 to form a processing apparatus in accordance with the invention.

In the first stage 8 of this apparatus, the pulp was carried in a stream of saturated steam at a superatmospheric pressure of 70 kPa at a temperature of 115° C. The steam was obtained as saturated excess steam from the cyclone 12 at the end of stage 8, via line 7. The stream of steam and pulp was introduced into the first stage 8 in such a way that a turbulent flow of pulp through the stage was obtained. Fans 9 were used to aid in transport of the pulp through the stage 8. The pulp proceeded through the stage 8 at a rate of about 10 meters per second, and the total traverse time through the stage 8 was eight seconds. The pulp solids content on leaving stage 8 was 45%. Before the pulp left stage 8, steam was separated from the pulp in the cyclone 12 and this steam recycled through line 20 to steam the wood material supplied to the digestion, in part, and as recycled carrier steam through line 7.

The chemically bleached pulp was delivered from stage 8 by way of a sluice or rotary vane feeder 13, washed with water, and analyzed. The water obtained for washing had only traces of peroxide.

The pulp analysis results are given in Table I, which follows Example 2.

EXAMPLE 2

Chemimechanical washed birch cellulose pulp, obtained by partial delignification with sodium bisulfite followed by defibration in a disc refiner, and having a brightness of 66% SCAN, was processed in the apparatus shown in FIG. 1. First, the pulp was mixed in mixer 1 with hot water and 0.2% diethylenetriamine pentaacetic acid based on the dry weight of the pulp to a pulp consistency of 4% at a temperature of 62° C. The pulp was allowed to stand for thirty minutes, and then dewatered to a 35% solids content. The dewatered pulp was then shredded to pieces approximately 1 $cm^2$, and mixed in mixer 3 with an aqueous bleaching solution of 28 g/l hydrogen peroxide, 50 g/l sodium silicate, 18 g/l sodium hydroxide and 0.2 g/l magnesium sulfate. After mixing in the bleaching solution, the pulp was dewatered in a press to a 50% solids content, in order to remove excess bleaching chemicals. The dewatered pulp was found by analysis to contain 3% hydrogen peroxide, 5% sodium silicate, 1.5% sodium hydroxide and 0.02% magnesium sulfate, based on the dry weight of the pulp.

The pulp was then ground in disc refiner 5 to individual fibers and fiber bundles, and then continuously fed by way of sluice feeder 6 into stage 8 of FIG. 1.

In this apparatus, the pulp was carried on a stream of saturated steam at a superatmospheric pressure of 70 kPa at a temperature of 115° C. The steam was obtained as saturated excess steam from the end of stage 8 and was introduced into stage 8 in such a way that a turbulent flow of pulp through the stage was obtained. Fans 9 were used to aid in transport of the pulp through the stage 8. The pulp proceeded through stage 8 at a rate of about 10 meters per second, and the total traverse time through the stage was 8 seconds. The pulp solids content on leaving stage 8 was 45%. Before the pulp left the stage, steam was separated from the pulp in a cyclone, and this steam recycled to steam the wood material supplied to the digestion, in part.

The chemically bleached pulp was delivered from stage 8 by way of a rotary vane feeder 13. After leaving feeder 13, the pulp was continuously introduced at substantially constant solids content, without washing, into a counter-pressure drying unit 15 of U.S. Pat. No. 4,043,049, equipped with circulating fans 14, and in which the drying agent was superheated steam at a superatmospheric pressure of 300 kPa and a temperature of 150° C. The heat exchangers (not shown) for heating the carrier steam were heated with steam at 160° C., with the result that the carrier steam was rapidly superheated, with a rapid transfer of moisture from the pulp to the carrier steam. Both pulp and steam were then led to a cyclone 16, in which the steam was separated from the pulp, and recycled via line 17 to the beginning of the drying stage. The pulp was delivered via the rotary vane feeder 19 from the cyclone. The solids content of the dried pulp was 91.2%, and it had a pH of 7.7. The pulp was analyzed, and the results are given in Table I below.

Two controls were run, for comparison with Examples 1 and 2 of the invention.

In Control 1, chemimechanical washed birch cellulose pulp, obtained by partial delignification with sodium bisulfite followed by defibration in a disc refiner, and having a brightness of 66% SCAN, was mixed in mixer 1 with hot water and 0.2% diethylenetriamine pentaacetic acid based on the dry weight of the pulp to a pulp consistency of 4% at a temperature of 62° C. The pulp was allowed to stand for thirty minutes, then dewatered to a 35% solids content. The dewatered pulp was then shredded to pieces approximately 1 $cm^2$ and mixed in mixer 3 with an aqueous bleaching solution of 28 g/l hydrogen peroxide, 50 g/l sodium silicate, 18 g/l sodium hydroxide and 0.2 g/l magnesium sulfate. After mixing in the bleaching solution, the pulp was dewatered in a press to a 50% solids content, in order to remove excess chemicals. The dewatered pulp was found by analysis to contain 3% hydrogen peroxide, 5% sodium silicate, 1.5% sodium hydroxide and 0.02% magnesium sulfate, based on the dry weight of the pulp.

The pulp was then ground in disc refiner 5 to individual fibers and fiber bundles and then continuously fed by way of the sluice feeder into stage 15 of the counter-pressure dryer shown in FIG. 1, as used in Example 2, in which the drying agent was superheated steam at a superatmospheric pressure of 300 kPa and a temperature of 150° C. The pulp was thus simultaneously subjected to bleaching and drying while passing through the counter-pressure dryer, and the solids content increased from 50% to 91.5%. This pulp (Control 1) was analyzed, and the analytical results are given in Table I.

As Control 2, chemimechanical washed birch cellulose pulp, obtained by partial delignification with sodium bisulfite followed by defibration in a disc refiner, and having a brightness of 66% SCAN, was mixed in mixer 1 with hot water and 0.2% diethylenetriamine pentaacetic acid based on the dry weight of the pulp to a pulp consistency of 4% at a temperature of 62° C. The pulp was allowed to stand for thirty minutes and then dewatered to a 35% solids content. The dewatered pulp was then shredded to pieces approximately 1 $cm^2$ and mixed in mixer 3 with a bleaching aqueous solution of 28 g/l hydrogen peroxide, 50 g/l sodium silicate, 18 g/l sodium hydroxide and 0.2 g/l magnesium sulfate. After mixing in the bleaching solution, the pulp was dewatered in a press to a 50% solids content, in order to remove excess bleaching chemicals. The dewatered pulp was found by analysis to contain 3% hydrogen peroxide, 5% sodium silicate, 1.5% sodium hydroxide and 0.02% magnesium sulfate based on the dry weight of the pulp.

The pulp was then ground in disc refiner 5 to individual fibers and fiber bundles, and then continuously fed by way of a sluice feeder into the flash dryer described in U.S. Pat. No. 3,492,199. The drying air was heated with the aid of an oil burner to a temperature of 450° C. At the end of the drying operation, the drying air temperature was 120° C. This pulp (Control 2) was analyzed and the analytical results are given in Table I.

TABLE I

| Treatment | Starting pulp | Method according to the invention: Example 1 Bleaching | Example 2 Bleaching followed by drying | Comparison with simultaneous bleaching and drying of the prior art: Control 1 Drying in flash dryer of No. 4,043,049 | Control 2 Drying in flash dryer of No. 3,492,199 |
|---|---|---|---|---|---|
| Solids content % | 50 | 45.0 | 91.2 | 91.5 | 91.1 |
| Brightness SCAN % | 66.0 | 85.3 | 85.5 | 73.0 | 72.5 |
| Increase in brightness SCAN % | — | 19.3 | 19.5 | 7.0 | 6.5 |
| Fiber bundles number per 100 g pulp | 0 | 60 | 250 | 280 | 1050 |
| pH | 5.6 | 8.2 | 7.7 | 7.8 | 6.2 |

The results in Table I show that, quite surprisingly, when the process of the invention is used it is possible to bleach chemimechanical birch pulp in an extremely short time to a very high brightness, and thereafter to dry the pulp without intermediate treatment to a solids content of about 91%, while maintaining an acceptable number of fiber bundles.

As each of Control 1 and Control 2 show, the bleaching result is considerably worse if the bleaching and drying are carried out at the same time. In this case, the poor bleaching result possibly can be explained by the fact that the bleaching solution evaporates before it has had time to have any substantial bleaching effect, whereas at the superatmospheric pressure of the invention, no evaporation can take place.

The brightness results show that only about one-third of the optimum bleaching effect is obtained when simultaneously bleaching and drying, as in the Controls. The process of the invention is furthermore very economical in energy consumption.

EXAMPLE 3

Chemimechanical birch pulp produced by delignification with sodium bisulfite and defibration in a disc refiner, followed by washing, and having a brightness of 66% SCAN, was processed in the apparatus shown in FIG. 1. First, the pulp was mixed in mixer 1 with hot water and 0.2% diethylenetriamine pentaacetic acid based on the dry weight of the pulp to a pulp consistency of 4% at a temperature of 62° C. The pulp was allowed to stand for thirty minutes, and then dewatered to a 35% solids content. The dewatered pulp was then shredded to pieces approximately 1 $cm^2$, and mixed in mixer 3 with an aqueous bleaching solution of 28 g/l hydrogen peroxide, 50 g/l sodium silicate, 18 g/l sodium hydroxide and 0.2 g/l magnesium sulfate. After mixing in the bleaching solution, the pulp was dewatered in press 4 to a 50% solids content, in order to remove excess bleaching chemicals. The dewatered pulp was found by analysis to contain 3% hydrogen peroxide, 5% sodium silicate, 1.5% sodium hydroxide and 0.02% magnesium sulfate, based on the dry weight of the pulp.

The pulp was then ground in disc refiner 5 to individual fibers and fiber bundles, and then continuously fed by way of sluice feeder 6 into stage 8 of FIG. 1.

In stage 8, the carrier steam was saturated steam at 105° C., under a superatmospheric pressure of 20 kPa. Transit time was seven seconds. Upon leaving stage 8, the steam and pulp were run through cyclone 12, where the steam was separated and used for steaming the lignocellulosic material fed to the digestion process.

The chemically treated pulp was delivered from stage 8 by way of rotary vane feeder 13, and brought to a storage tank, where it was stored for fifteen minutes at a solids content of 47%. The temperature of the pulp at the end of the storage time was 90° C. Analysis of the pulp showed a hydrogen peroxide content of 0.1%, with a pulp brightness of 84.9% SCAN.

The results show that in the process of the invention, a milder chemical treatment at a lower temperature can be combined with a short after-treatment, such as a residence period in the storage tank, for completing the bleaching process, and so reach a high brightness in the bleached pulp.

EXAMPLE 4

Chemimechanical birch pulp produced by delignification with sodium bisulfite and defibration in a disc refiner, followed by washing, and having a brightness of 66% SCAN, was processed in the apparatus shown in FIG. 1. First, the pulp was mixed in mixer 1 with hot water and 0.2% diethylenetriamine pentaacetic acid based on the dry weight of the pulp to a pulp consistency of 4% at a temperature of 62° C. The pulp was allowed to stand for thirty minutes, and then dewatered to a 35% solids content. The dewatered pulp was then shredded to pieces approximately 1 $cm^2$, and mixed in mixer 3 with an aqueous bleaching solution of 28 g/l hydrogen peroxide, 50 g/l sodium silicate, 18 g/l sodium hydroxide and 0.2 magnesium sulfate. After mixing in the bleaching solution, the pulp was dewatered in a press 4 to a 50% solids content, in order to remove excess bleaching chemicals. The dewatered pulp was found by analysis to contain 3% hydrogen peroxide, 5% sodium silicate, 1.5% sodium hydroxide and 0.02% magnesium sulfate, based on the dry weight of the pulp.

The pulp was then ground in disc refiner 5 to individual fibers and fiber bundles, and then continuously fed by way of sluice feeder 6 into stage 8 of FIG. 1.

In stage 8, the carrier steam was saturated steam at 105° C., under a superatmospheric pressure of 20 kPa. Transit time was seven seconds. Upon leaving stage 8, the steam and pulp were run through cyclone 12, where the steam was separated and used for steaming the lignocellulosic material fed to the digestion process.

The chemically treated pulp was delivered from stage 8 by way of rotary vane feeder 13 and brought to a storage tank, where it was diluted to a concentration of 4%, using a hot aqueous sodium dithionite solution, so that the temperature after mixing with the pulp was 76° C. The amount of sodium dithionite charged was 0.4% based on the weight of dry pulp. The pulp residence time in the storage tank was 10 minutes.

Analysis of the pulp at the end of this time showed that it had a brightness of 88.3% SCAN, an extremely high brightness for a chemimechanical pulp, and comparable to the brightness of a fully bleached chemical pulp.

EXAMPLE 5

Chemimechanical washed birch cellulose pulp, obtained by partial delignification with sodium bisulfite followed by defibration in a disc refiner, and having a brightness of 66% SCAN, was processed in the apparatus shown in FIG. 1. First, the pulp was mixed in mixer 1 with hot water and 0.2% diethylenetriamine pentaacetic acid based on the dry weight of the pulp to a pulp consistency of 4% at a temperature of 62° C. The pulp was allowed to stand for thirty minutes, and then dewatered in the press 2 to a 35% solids content. The dewatered pulp was then shredded to pieces approximately 1 $cm^2$, and mixed in mixer 3 with an aqueous bleaching solution of 28 g/l hydrogen peroxide, 50 g/l sodium silicate, 18 g/l sodium hydroxide and 0.2 g/l magnesium sulfate. After mixing in the bleaching solution, the pulp was dewatered in screw press 4 to a 50% solids content, in order to remove excess bleaching chemicals. The dewatered pulp was found by analysis to contain 3% hydrogen peroxide, 5% sodium silicate, 1.5% sodium hydroxide and 0.02% magnesium sulfate, based on the dry weight of the pulp.

The pulp was then ground in disc refiner 5 to individual fibers and fiber bundles, and then continuously fed by way of sluice feeder 6 into stage 8 of FIG. 1.

In this stage, the pulp was carried on a stream of saturated steam at a superatmospheric pressure of 70 kPa at a temperature of 115° C. The pulp proceeded through the stage at a rate of about 10 meters per second, and the total traverse time through the stage was eight seconds. The pulp solids content on leaving the stage was 45%. When the pulp left stage 8, steam was separated from the pulp in a cyclone 12 and some steam recycled to steam the wood material supplied to the digestion. The chemically processed pulp was delivered from stage 8 by way of rotary vane feeder 13 and then gaseous sulfur dioxide was added, in an amount corresponding to 0.3% based on the dry weight of the pulp. The $SO_2$-impregnated pulp was then continuously introduced at substantially constant solids content without washing into stage 15 of the counter-pressure drying unit of U.S. Pat. No. 4,043,049, in which the drying agent was superheated steam at a superatmospheric pressure of 300 kPa and a temperature of 150° C. The heat exchangers for heating the carrier steam were supplied with steam at 160° C., with the result that the carrier steam was rapidly superheated, with a rapid transfer of moisture from the pulp to the carrier steam. Both pulp and steam were then led to cyclone 16, in which the steam was separated from the pulp.

The solids content of the pulp after passing through the counter-pressure dryer was 91.8%, brightness was 85.2% SCAN, and pH was 7.0.

Thus, by addition of sulfur dioxide it is possible in the process of the invention to bleach and dry the pulp, as well as adjust the pH to a desired level.

EXAMPLE 6

Washed spruce groundwood pulp, obtained by grinding spruce chips on a conventional wood chip grinder and having a brightness of 62% SCAN, was passed through a disc refiner and fed by way of the sluice feeder into a modified flashed dryer of FIG. 1, immediately after passing through the sluice feeder, being sprayed with an aqueous bleaching solution containing sodium dithionite and ethylenediamine tetraacetic acid as a complexing agent, in amounts such that the pulp contained 0.8% sodium dithionite and 0.15% of the EDTA complexing agent, based on the dry weight of the pulp.

In stage 8, the pulp was carried on a stream of saturated steam at a superatmospheric pressure of 70 kPa at a temperature of 115° C. The pulp proceeded through stage 8 at a rate of about 10 meters per second, and the total traverse time through the stage was eight seconds. The pulp solids content on leaving stage 8 was 45%. Steam was separated from the pulp in cyclone 12, and some steam recycled to steam the wood material supplied to the digestion.

The bleached pulp was delivered by way of rotary vane feeder 13 at substantially constant solids content, without washing, into stage 15 the counter-pressure drying unit of U.S. Pat. No. 4,043,049, in which the drying agent was superheated steam at a superatmospheric pressure of 300 kPa at a temperature of 150° C. The heat exchangers for heating the carrier steam were supplied with steam at 160° C., with the result that the carrier steam was rapidly superheated, with a rapid transfer of moisture from the pulp to the carrier steam. Both pulp and steam were then led to cyclone 16, in which the steam was separated from the pulp.

The bleached pulp had a solids content of 91.9%, and a brightness of 73% SCAN, a very high brightness, considering that sodium dithionite was used as the bleaching agent.

As a control, another batch of the same spruce groundwood pulp having a brightness of 62% SCAN, was passed through a disc refiner and then continuous fed by way of sluice feeder into the conventional flash dryer as described in U.S. Pat. No. 3,492,199, immediately after passing through the sluice feeder being sprayed with an aqueous bleaching solution containing sodium dithionite and ethylenediamine tetraacetic acid as a complexing agent, in amounts such that the pulp contained 0.8% sodium dithionite and 0.15% of the EDTA complexing agent, based on the dry weight of the pulp.

The flash dryer was heated with the aid of an oil burner to a temperature of 450° C. At the end of the drying operation, the drying air temperature was 120° C. The resulting bleached pulp had a solids content of 91.5%, while its brightness was only 63% SCAN.

These results show that the bleaching and drying process of the invention gives a very good bleaching effect, while simultaneous bleaching and drying in a conventional flash dryer gives only a small improvement in brightness. A possible explanation may be that sodium dithionite decomposes in a conventional flash dryer, because of the presence of oxygen in the drying air. When bleaching in a steam atmosphere under superatmospheric pressure in accordance with the invention, in the absence of oxygen in the carrier steam, the sodium dithionite is not lost, and so the bleaching is not disturbed.

According to the technical literature, the maximum increase in brightness as % SCAN obtainable with sodium dithionite bleaching for a period of 60 minutes at a 4% pulp consistency is about 10 to 11%. The process of the invention results in an increase in brightness of 11%, which shows that the maximum increase in brightness was obtained.

EXAMPLE 7

Thermomechanical pulp produced from 50% spruce and 50% aspen wood, with a brightness of 56.1% SCAN, was mixed with an aqueous solution of 0.2% diethylene triamine pentaacetic acid in hot water in a mixer, to a pulp consistency of 4% at a temperature 62° C. The pulp was then dewatered to a 35% solids content. The dewatered pulp was mixed in a mixer with an aqueous bleaching solution containing 22 g/l hydrogen peroxide, 40 g/l sodium silicate, 12 g/l sodium hydroxide and 0.1 g/l magnesium sulfate, and then pressed in a press to a 50% solids content. The dewatered pulp contained 2% hydrogen peroxide, 4% sodium silicate, 1% sodium hydroxide and 0.01% magnesium sulfate based on the dry weight of the pulp.

The pulp thus impregnated with bleaching agents was taken through disc refiner 5, and then fed into stage 8 of the apparatus of FIG. 1. The carrier steam temperature in stage 8 was 114° C., under a superatmospheric pressure of 64 kPa. This steam was composed of saturated excess steam coming partly from the steam separator after stage 8 and partly from the steam separator after stage 15, and introduced via fan 9 into stage 8, so that a turbulent flow of pulp through stage 8 was obtained. The residence time of the pulp in stage 8 was nine seconds, and in stage 15 twelve seconds, and the pulp was dried to a solids content of 90.5% by the time it had completed its passage through the dryer.

The brightness of the bleached and dried pulp was 79.2% SCAN, which is a very high brightness for thermomechanical pulp. Usual tower bleaching of such pulp would have required a charge of 3% hydrogen peroxide, and a bleaching time of two hours.

EXAMPLE 8

Spruce wood sulfite pulp, bleached in one step with chlorine dioxide, and neutralized with sodium hydroxide, having a viscosity of 1150 $dm^3/kg$ according to SCAN, an extractives content of 0.42% SCAN, a brightness of 69% SCAN, and a solids content of 30%, was mixed with a dilute aqueous bleaching solution of sodium hypochlorite and sodium hydroxide to a 10% pulp consistency, and then dewatered to a solids content of 52%. The dewatered pulp contained 0.7% sodium hypochlorite calculated as active chlorine, and 0.5% sodium hydroxide based on the dry weight of the pulp.

The pulp was shredded into flakes in disc refiner 5, and then introduced into stage 8 of the apparatus of FIG. 1. Carrier steam at 120° C. entered stage 8, corresponding to a superatmospheric pressure of 100 kPa. The residence time of the pulp in stage 8 was eight seconds and in stage 15 twelve seconds.

The bleached pulp had a solids content of 90.1%, a viscosity of 1105 $dm^3/kg$, an extractives content of 0.42%, and a brightness of 89.5%.

It is apparent from these results that, using the process of the invention, it is possible to bleach sulfite spruce pulp in a very short time, without noticeable decomposition of the carbohydrates, in comparison with conventional tower bleaching, which would have required a bleaching time of several hours.

EXAMPLE 9

A semi-bleached pine sulfate pulp having a brightness of 76% SCAN and a viscosity of 945 $dm^3/kg$ was mixed with an aqueous bleaching solution of diethylenetriamine pentaacetic acid, hydrogen peroxide, sodium hydroxide, and water, such that the pulp consistency was 8%. The suspension was then thickened to a solids content of 45%. The dewatered pulp contained 0.8% hydrogen peroxide, 0.2% diethylenetriamine pentaacetic acid, and 0.6% sodium hydroxide.

The pulp was shredded to flakes in disc refiner 5 and then, introduced into stage 8 of the apparatus of FIG. 1. Carrier steam at 120° C. entered stage 8, corresponding to a superatmospheric pressure of 100 kPa. The residence time of the pulp in stage 8 was nine seconds and in stage 15 twelve seconds.

The bleached pulp had a solids content of 91.3%, a viscosity of 922 $dm^3/kg$, and a brightness of 85% SCAN. This viscosity is surprisingly high, considering that the brightness was increased by 9%.

The results show that by the process of the invention it is possible to bleach pine sulfate pulp without noticeable degradation of the carbohydrates in a very short time, in comparison with conventional tower bleaching, which would have required a bleaching time of several hours.

EXAMPLE 10

Screened spruce sulfite pulp having a brightness of 62% SCAN, a viscosity of 1140 $dm^3/kg$, and an extractives content of 1.88% SCAN, was mixed with sodium hydroxide and water to a pulp consistency of 10%, and then thickened to a solids content of 42%. The resulting pulp contained 2% sodium hydroxide. It was then introduced into stage 8 of the apparatus of FIG. 1. The carrier was saturated steam at a temperature of 115° C., corresponding to a superatmospheric pressure of 69 kPa. The transit time for the pulp through stage 8 was twelve seconds. The steam was then separated from the pulp by passing the mixture into cyclone 12. The pulp was fed out by way of rotary vane feeder 13 and then brought to a storage tank, where it was diluted with hot water. The pulp exiting from the feeder had a solids content of 39.5%, a viscosity of 1055 $dm^3/kg$, and an extractives content of 0.38% SCAN.

The results show that the process in accordance with the invention makes it possible by alkaline extraction to effectively deresinate sulfite pulp in a very short time. Conventional alkaline extraction for deresination in a tower requires a time of at least one hour.

EXAMPLE 11

In this Example, pulp was bleached under superatmospheric pressure in a closed apparatus provided with a screw conveyor. A turbulent flow of pulp through the apparatus was provided mechanically, by way of the screw conveyor. The screw conveyor was placed at the bottom of the apparatus, and disposed horizontally, conveying the pulp through the apparatus at a rate of about 1 meter/second to a pressure cyclone directly connected to the discharge end of the screw. This cyclone in turn was provided with a screw feeder, for controlling the transit time of the pulp through the cyclone.

Thermomechanical spruce pulp having a solids content of 33% was taken out directly from the disc refiner in which the pulp had been defibrated and brought to a chemical mixer under the same superatmospheric prressure as the disc refiner, in this case 150 kPa. An aqueous solution of bleaching chemicals was then mixed into the pulp in an amount to give, by weight of the dry pulp, 3% hydrogen peroxide, 5% sodium silicate, 1.5% sodium hydroxide, 0.02% $MgSO_4.7H_2O$, and 0.2% diethylenetriamine pentaacetic acid. The pulp was then dewatered to a solids content of 32% at a temperature of 110° C.

This pulp impregnated with the bleaching chemicals was then carried by way of a high consistency pump into the processing apparatus described above. While passing through the apparatus, the pulp was under an oxygen-free steam atmosphere at a temperature of 107° C. and a superatmospheric pressure of 30 kPa. The transit time for the pulp through the apparatus was 6 seconds. The pulp was then taken to the pressure cyclone, where the steam was separated from the pulp, and the pulp allowed to fall down into the screw discharger. The time of passage through the cyclone and the screw discharger was about 3 seconds.

The pulp delivered at the end of the screw disc discharger had a temperature of 96° C. and a pulp consistency of 32%, and contained 0.06% residual peroxide. After diluting with cold water to a 4% pulp consistency, the pH of the resulting pulp suspension was 8.1. The diluted pulp was then dewatered to a pulp concentration of about 30% in a centrifuge, and dried to a solids content of about 92.4%. The brightness of the pulp was then measured, and found to be 74.3% ISO, which is surprisingly high, considering the short bleaching time, and the relatively simple bleaching installation employed.

EXAMPLE 12

In this Example, pulp was bleached under superatmospheric pressure in a closed apparatus provided with a screw conveyor. A tubulent flow of pulp through the apparatus was provided mechanically, by way of the screw of the conveyor. The screw conveyor was placed at the bottom of the apparatus, and disposed horizontally, conveying the pulp through the apparatus at a rate of about 1 meter/second to a pressure cyclone directly connected to the discharge end of the screw. This cyclone in turn was provided with a screw feeder for controlling the transit time of the pulp through the cyclone.

Thermomechanical spruce pulp having a solids content of 33% in the last defibration stage was taken through a disc refiner in which during the defibration there was mixed into the pulp aqueous bleaching solutions of hydrogen peroxide, sodium silicate, sodium hydroxide, magnesium sulfate and diethylenetriamine pentaacetic acid, while the pulp was under superatmospheric steam pressure of 120 kPa, corresponding to a temperature of 123° C. During the refining, the aqueous solutions bleaching chemicals were added at different places along the radius of the grinding discs. An aqueous solution of diethylenetriamine pentaacetic acid and hydrogen peroxide was applied in a stream close to the center of the grinding discs, while an aqueous sodium hydroxide solution was applied at a point half way along the radius of the discs, and an aqueous sodium silicate solution was applied at a point about 5 cm from the outer edge of the discs. The pulp emerging from the disc refiner contained 0.15% DTPA, 3% $H_2O_2$, 1% NaOH and 3% $Na_2SiO_3$ based on the weight of the dry pulp.

The defibrated pulp was blown to a pressure cyclone connected to the processing apparatus provided with a screw conveyor. During the passage through the pressure cyclone and the screw conveyor, the steam pressure was reduced from 120 kPa to 50 kPa, and thereby the temperature was also reduced from 123° C. to 111° C. The transit time for the pulp through the processing apparatus screw conveyor was 4 seconds. The pulp was then blown to a second cyclone for separating steam from the pulp.

The pulp emerging from the cyclone was at 95° C. and contained 0.14% $H_2O_2$. The pulp consistency was 36%. After dilution with cold water to a pulp consistency of 4%, the pH of the pulp suspension was 8.2.

The diluted pulp suspension was dewatered to a pulp consistency of about 30% in a centrifuge, and dried to a solids content of 91.8%. The brightness of the pulp thus obtained was 74.6% ISO.

As this Example shows, in the manufacture of thermomechanical pulp it is possible to add the bleaching chemicals in the disc refiner, and then apply the method in accordance with the invention, with the result that a surprisingly bright pulp is obtained, in a short time, and with simple bleaching apparatus.

This Example shows that the process of the invention makes possible the bleaching of both mechanical and chemical pulp while the pulp is being transported with steam under superatmospheric pressure and with subsequent drying. Excess steam is obtained as a by-product of the process, apart from the bleaching effect, and this steam can be utilized elsewhere in a pulp mill, for example, for preheating the wood chips before they are digested, giving the process good heating economy. The bleaching chemical cost is also low, using the process of the invention.

When applied to the extraction of materials from the pulp, it becomes possible to carry out an effective extraction within a very short time, while the pulp is being conveyed by steam at superatmospheric pressure.

In both bleaching and extraction, the rapid reaction time means that plant requirements are low, with a resulting low investment cost for both apparatus and plant buildings. The use of high bleaching and extraction concentrations in the process of the invention also reduces pollution of the atmosphere.

The process can be carried out continuously by continuously feeding cellulose pulp into the reaction zone at one end, and continuously withdrawing the modified cellulose pulp at the other end of the zone. This is the preferred mode of operation, since control of the reaction time is easy to accomplish, in terms of transit time through the zone at a selected flow rate. However, it is also possible to carry out the process in a batch or semibatch procedure, in which a batch of cellulose pulp is passed through the zone. Whereas the continuous flow approach is best carried out by entraining the pulp in a flow of carrier steam, thus carrying it through the zone, the batch or semibatch approach is more easily carried out using a screw conveyor, or a train of buckets, or other mechanical means arranged to transport one entire batch of material at a time through the zone. Other variations will be apparent to those skilled in this art, and any continuous or batch flow reaction zone apparatus can be used. A continuous flow flash dryer is illustrated in the Examples, but elongated continuous flow reactors can of course be used as well.

Having regard to the foregoing disclosure, the following is claimed as patentable and inventive embodiments thereof.

1. A process for the chemical bleaching or alkaline refining of cellulose pulp which comprises, in sequence, the steps of:

(1) impregnating the cellulose pulp with refining chemicals in an amount selected to effect chemical modification of the pulp;

(2) adjusting the pulp consistency to within the range from about 30 to about 70%; and (3) passing the pulp in finely divided form and in turbulent flow through a reaction zone from one end to another end thereof in a gaseous atmosphere consisting essentially of steam at a superatmospheric pressure within the range from about 5 to about 400 kPa and a temperature within the range from about 100° to about 150° C. at which the chemical modification proceeds without a mechanical working sufficient to change the degree of beating of the pulp by more than about 2° (Schopper-Riegler) and the freeness of the pulp by more than about 10 ml, and with less than an 8% change in the pulp dry solids content, at a flow rate to create the turbulence such that the impregnated chemicals are substantially completely consumed by the time the pulp reaches the end of the zone.

2. A process in accordance with claim 1 in whcih the gaseous steam atmosphere contains less than 1% by volume of oxygen.

3. A process in accordance with claim 1 in which the refining chemicals comprise a bleaching agent.

4. A process in accordance with claim 1 in which the bleaching agent is a peroxide.

5. A process in accordance with claim 1 in which the refining chemicals comprise alkali.

6. A process in accordance with claim 1 in which the alkali is sodium hydroxide.

7. A process in accordance with claim 1, in which the solids content of the pulp during passage through the zone changes by less than 6%.

8. A process in accordance with claim 1 in which the pulp is brought to a pulp consistency within the range from about 45% to about 65%.

9. A process in accordance with claim 1 in which the refining chemical is a bleaching agent, the superatmospheric pressure is within the range from about 100 to about 200 kPa, and steam is removed from the pulp after discharge from the zone and recycled to the zone.

10. A process in accordance with claim 9 in which the cellulose pulp is a high-yield pulp, and the bleaching chemical is a peroxide.

11. A process in accordance with claim 9 in which the cellulose pulp is a high-yield pulp, and the bleaching chemical is dithionite.

12. A process in accordance with claim 9 in which before entry into the zone the pulp is impregnated with a complexing agent, dewatered to a consistency of from 10% to 35%, impregnated with bleaching agent, pressed and converted into flake form, and then passed into the zone.

13. A process in accordance with claim 1 in which the refining chemical is an alkali, the superatmospheric pressure is within the range from 50 to 300 kPa, steam is separated from the pulp upon discharge from the zone, and recycled to the zone, the refined pulp being washed and dried.

14. A process in accordance with claim 13 in which the pulp is a sulfite pulp, and the alkali is sodium hydroxide.

15. A process in accordance with claim 1 in which the refined pulp is dried.

16. A process in accordance with claim 15 in which the drying is carried out in a flash dryer.

17. A process in accordance with claim 16 in which the flash drying is carried out with superheated steam in direct contact with pulp.

18. A process in accordance with claim 17 in which excess steam from the drying is recycled.

19. A process in accordance with claim 1 in which the cellulose pulp is continuously fed into the reaction zone at one end and withdrawn from the reaction zone at the other end, controlling the traverse time through the zone such that the impregnating chemicals are substantially consumed by the time the pulp reaches the end of the zone.

20. A process in accordance with claim 1 in which the cellulose pulp is fed into the reaction zone in batches and conveyed as batches through the zone from one end and withdrawn from the reaction zone at the other end, controlling the traverse time through the zone such that the impregnating chemicals are substantially consumed by the time the pulp reaches the end of the zone.

* * * * *

UNITED STATES PATENT AND TRADEMARK OFFICE

CERTIFICATE OF CORRECTION

PATENT NO. : 4,244,778

DATED : January 13, 1981

INVENTOR(S) : Jonas A. I. Lindahl

It is certified that error appears in the above-identified patent and that said Letters Patent are hereby corrected as shown below:

| | | |
|---|---|---|
| Column 1, line 52 | : | "notes" should be --knots-- |
| Column 6, line 48 | : | after "good" insert --heat-- |
| Column 7, line 1 | : | "pump" should be --pulp-- |
| Column 11, line 26 | : | after "0.2" insert --g/l-- |
| Column 12, line 50 | : | "a" should be —the-- |
| Column 13, line 17 | : | "continuous" should be --continuously-- |
| Column 13, line 18 | : | after "of" insert --a-- |
| Column 15, line 46 | : | "prres" should be --pres-- |
| Column 18, line 3 | : | "whcih" should be --which-- |

Signed and Sealed this

*Thirtieth* Day of *April 1985*

[SEAL]

*Attest:*

DONALD J. QUIGG

*Attesting Officer*

*Acting Commissioner of Patents and Trademarks*